US009282861B2

(12) United States Patent
Schultz et al.

(10) Patent No.: US 9,282,861 B2
(45) Date of Patent: Mar. 15, 2016

(54) WET/DRY VACUUM CLEANER WITH BUILT-IN DUSTPAN ACCESSORY

(71) Applicant: Emerson Electric Co., St. Louis, MO (US)

(72) Inventors: Douglas Schultz, St. Louis, MO (US); Douglas K. Ritterling, St. Louis, MO (US); Shane Glasgow, St. Louis, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 370 days.

(21) Appl. No.: 13/893,307

(22) Filed: May 13, 2013

(65) Prior Publication Data

US 2014/0215750 A1 Aug. 7, 2014

Related U.S. Application Data

(63) Continuation of application No. 13/655,353, filed on Oct. 18, 2012, now abandoned.

(60) Provisional application No. 61/548,679, filed on Oct. 18, 2011.

(51) Int. Cl.

| | |
|---|---|
| ***A47L 5/38*** | (2006.01) |
| ***A47L 9/00*** | (2006.01) |
| ***A47L 5/36*** | (2006.01) |
| ***A47L 5/22*** | (2006.01) |
| ***A47L 7/00*** | (2006.01) |
| ***A47L 9/02*** | (2006.01) |
| ***A47L 9/26*** | (2006.01) |
| ***A47L 13/52*** | (2006.01) |

(52) U.S. Cl.

CPC ..... *A47L 9/0018* (2013.01); *A47L 5/225* (2013.01); *A47L 5/365* (2013.01); *A47L 7/0004* (2013.01); *A47L 7/0023* (2013.01); *A47L 9/0027* (2013.01); *A47L 9/0036* (2013.01); *A47L 9/02* (2013.01); *A47L 9/26* (2013.01); *A47L 13/52* (2013.01)

(58) Field of Classification Search

CPC ..... A47L 9/0018; A47L 5/225; A47L 5/365; A47L 7/0023; A47L 9/0027

USPC ..... 15/323, 331, 327.7, 327.1, 327.2, 310, 15/328, 339

IPC ..... A47L 5/38

See application file for complete search history.

(56) References Cited

U.S. PATENT DOCUMENTS

| | | | |
|---|---|---|---|
| 5,279,016 | A | 1/1994 | Klassen |
| 5,437,078 | A | 8/1995 | Courcelles |
| 5,504,967 | A | 4/1996 | Graham |

(Continued)

*Primary Examiner* — David Redding

(74) *Attorney, Agent, or Firm* — Sutton McAughan Deaver PLLC

(57) ABSTRACT

Described is a vacuum cleaner, such as a wet/dry vacuum cleaner, having an improved vacuum hose storage assembly and dust pan assembly for use with a vacuum cleaner having a debris collection drum. The integrated pickup port in the dust pan can be formed by the shape of the product its used on or become a separate piece such as used in this design. The advantage of having the design integrated in the vacuum allows the user to pick up debris either collected by a broom or by other means into the collection chamber of the vacuum without having to remove the hose from the storage position and without having to hold the product while in use; freeing the users hands to control the broom or other device to direct additional debris to the vacuum for collection.

20 Claims, 11 Drawing Sheets

(56) References Cited

U.S. PATENT DOCUMENTS

| | | | |
|---|---|---|---|
| 5,560,077 | A | 10/1996 | Crotchett |
| 5,722,112 | A | 3/1998 | Scanni et al. |
| 6,029,311 | A | 2/2000 | Scanni et al. |
| 6,230,361 | B1 | 5/2001 | Griffin |
| 7,287,301 | B2 | 10/2007 | Marshall et al. |
| 7,578,024 | B2 | 8/2009 | Hughes |
| 7,707,683 | B2 | 5/2010 | Nurudeen |
| 7,784,137 | B2 | 8/2010 | Knopnow |
| 8,028,437 | B2 | 10/2011 | Brown-Carter |
| 8,108,966 | B1 | 2/2012 | Viviano |
| 8,250,703 | B2 | 8/2012 | Marshall et al. |
| 8,627,538 | B2 | 1/2014 | Phelan et al. |

WET/DRY VACUUM CLEANER WITH BUILT-IN DUSTPAN ACCESSORY

CROSS REFERENCE TO RELATED APPLICATIONS

This application claims priority to U.S. Provisional Patent application Ser. No. 61/548,679, filed Oct. 18, 2011, and incorporated herein by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to vacuum cleaners, and more specifically are related to devices which allow a wet/dry vacuum cleaner to have an integrated dust pan assembly associated with the body of the vacuum cleaner drum for the collection of debris, particularly larger debris, from surfaces.

2. Description of the Related Art

Vacuum cleaners, wet/dry or otherwise, are used for a myriad of tasks around the home and in the workplace. However, there are times when the debris to be picked up is minimal, or the user does not want to extend the effort to unwind and connect the vacuum hose to the vacuum cleaner so as to be able to pick up debris material with a vacuum.

The vacuum cleaner assembly described herein allows the user to pick up debris either collected by a broom or by other means into the collection chamber of the vacuum without having to remove the hose from the storage position and without having to hold the product while in use. The design allows an additional accessory nozzle to be nested inside the design allowing the port to function without having to remove the nozzle from the integrated port.

The inventions disclosed and taught herein are directed to an improved vacuum hose storage assembly and dust pan assembly for use with a vacuum cleaner having a debris collection drum. The integrated pickup port in the dust pan can be formed by the shape of the product its used on or become a separate piece such as used in this design. The advantage of having the design integrated in the vacuum allows the user to pick up debris either collected by a broom or by other means into the collection chamber of the vacuum without having to remove the hose from the storage position and without having to hold the product while in use; freeing the users hands to control the broom or other device to direct additional debris to the vacuum for collection.

BRIEF SUMMARY OF THE INVENTION

The integrated debris pickup port for a vacuum cleaner of the present invention, and which is removably attached, overcomes the limitations and issues set out above in a simple and efficient manner.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1A:
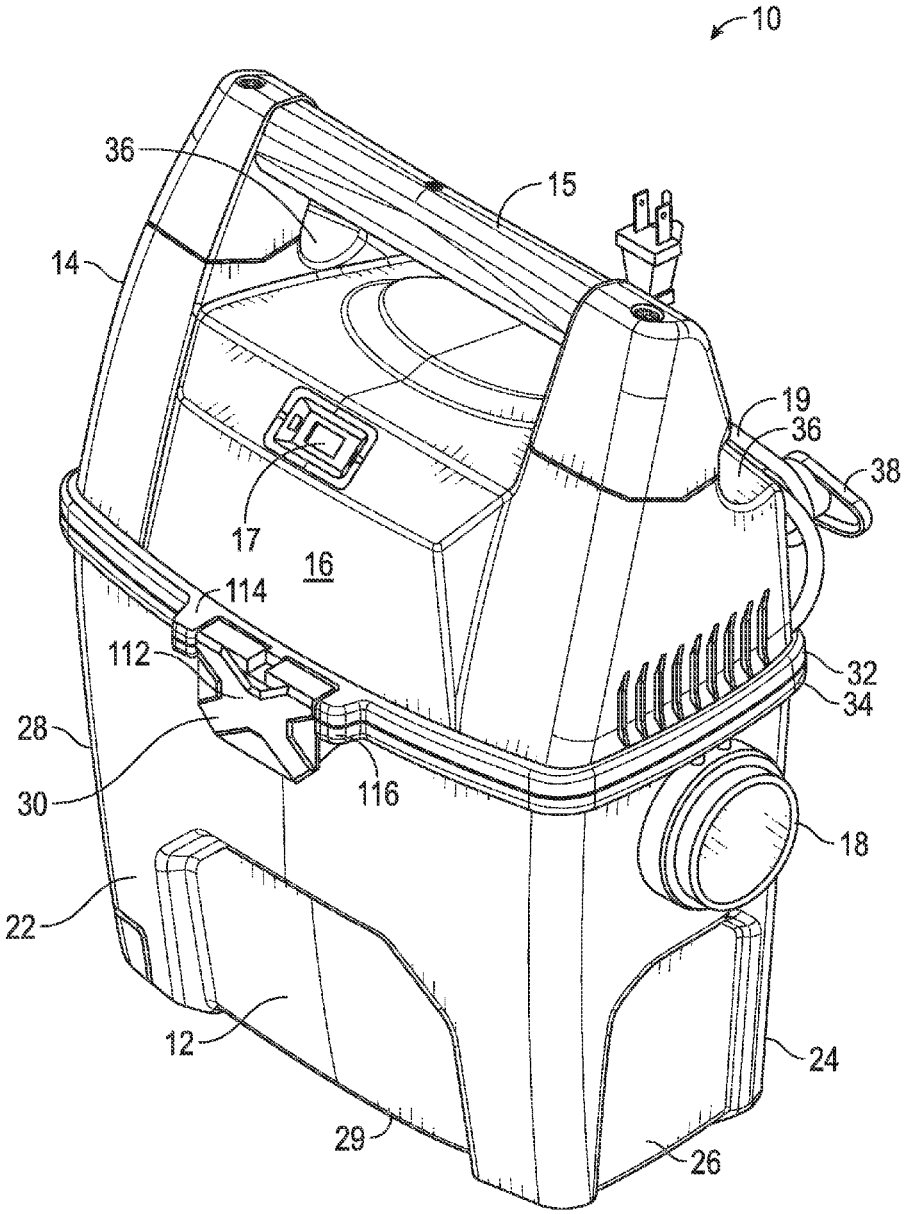
FIG. 1A illustrates a front isometric view of a vacuum cleaner assembly in accordance with the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, is such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created a dustpan assembly for use with vacuum cleaners that allows for both the efficient storage of vacuum nozzles when the vacuum is not in use, but also allows the vacuum to be used as a dustpan so as to pick up debris either collected by a broom or by other means into the collection chamber of the vacuum without having to remove the hose from the storage position and without having to hold the product while in use; freeing the users hands to control the broom or other device to direct additional debris to the vacuum for collection.

Figure 1B:
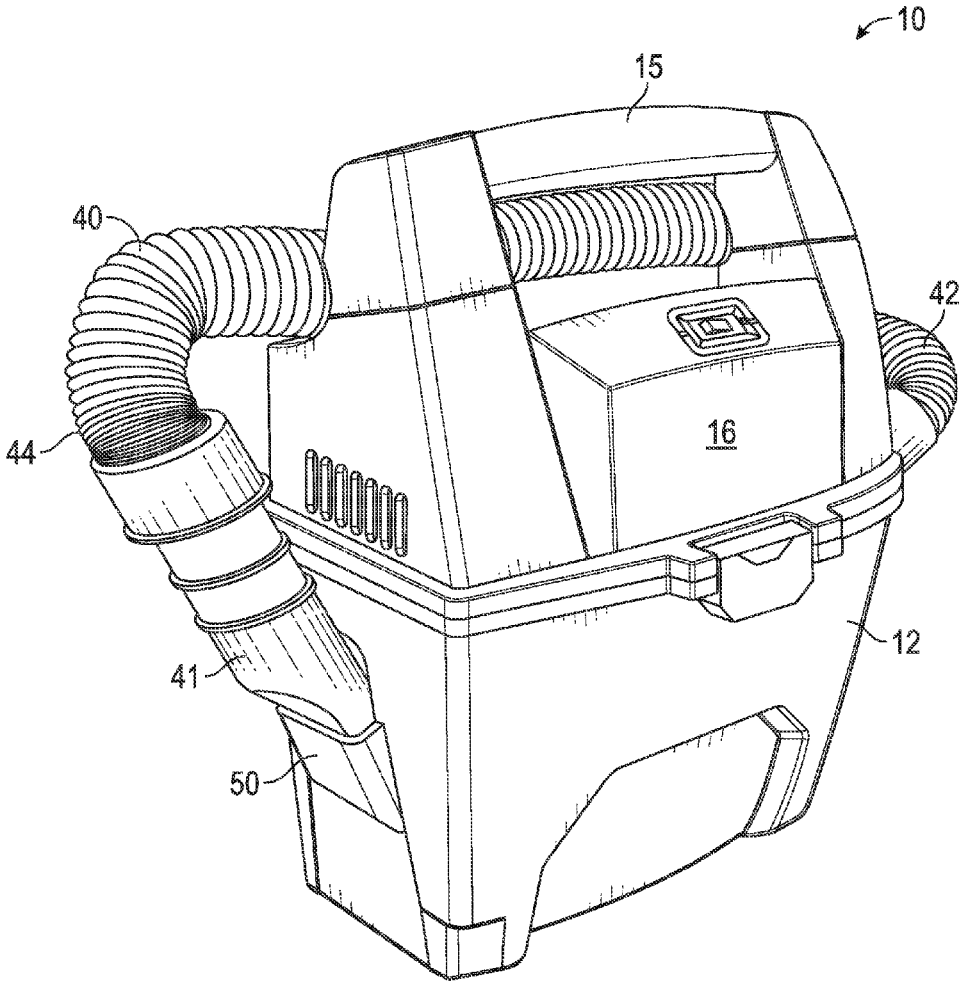
FIG. 1B illustrates an alternate front isometric view of the vacuum cleaner assembly of FIG. 1A, in the opposite orientation.
Figure 2:
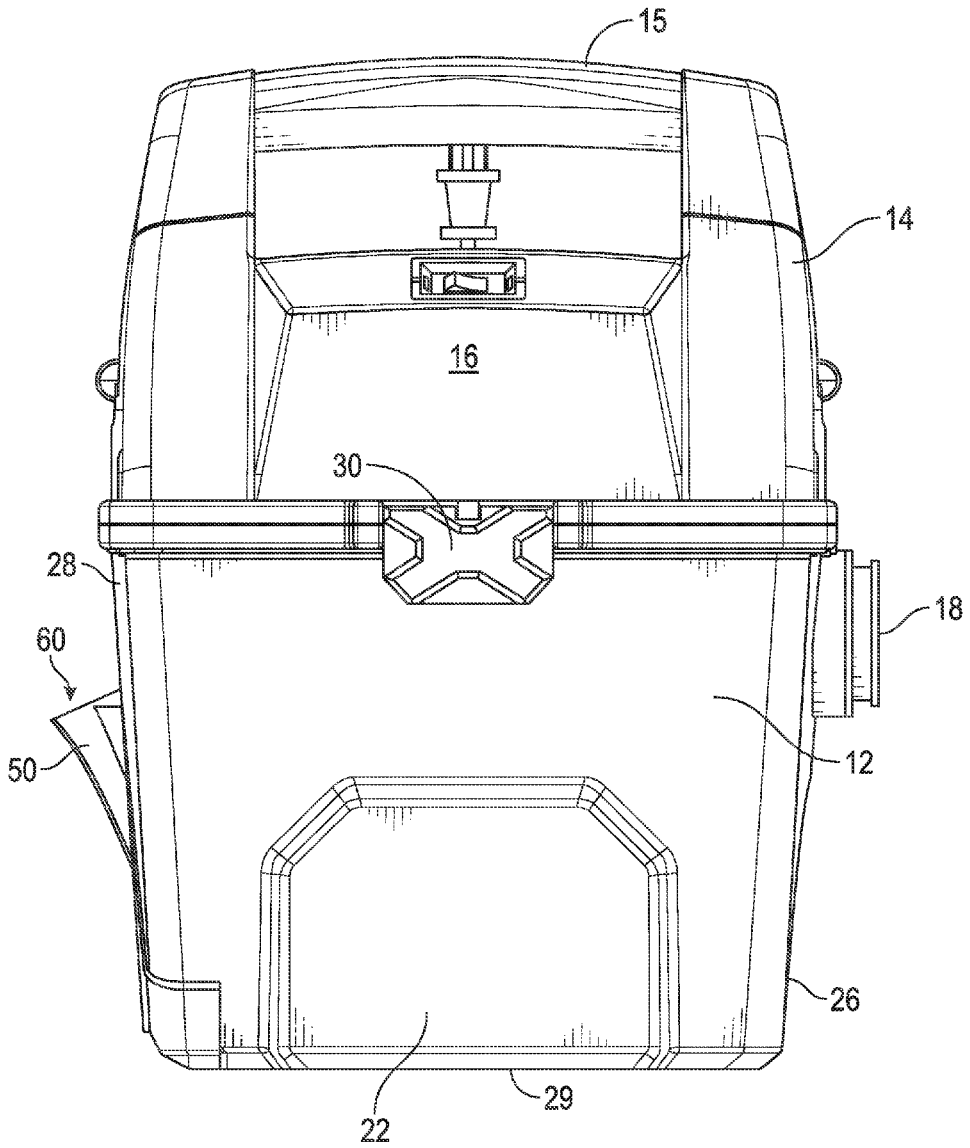
FIG. 2 illustrates a front view of the vacuum cleaner assembly of FIG. 1A.
Figure 3:
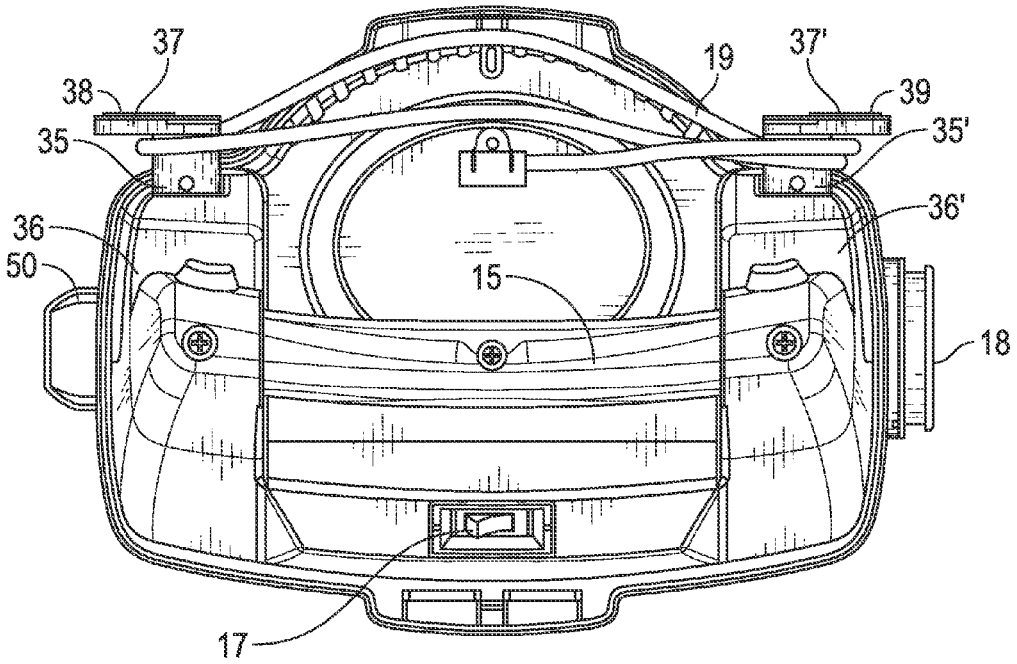
FIG. 3 illustrates a top view of the vacuum cleaner assembly of FIG. 1A, with the vacuum hose removed for purpose of clarity.
Figure 4:
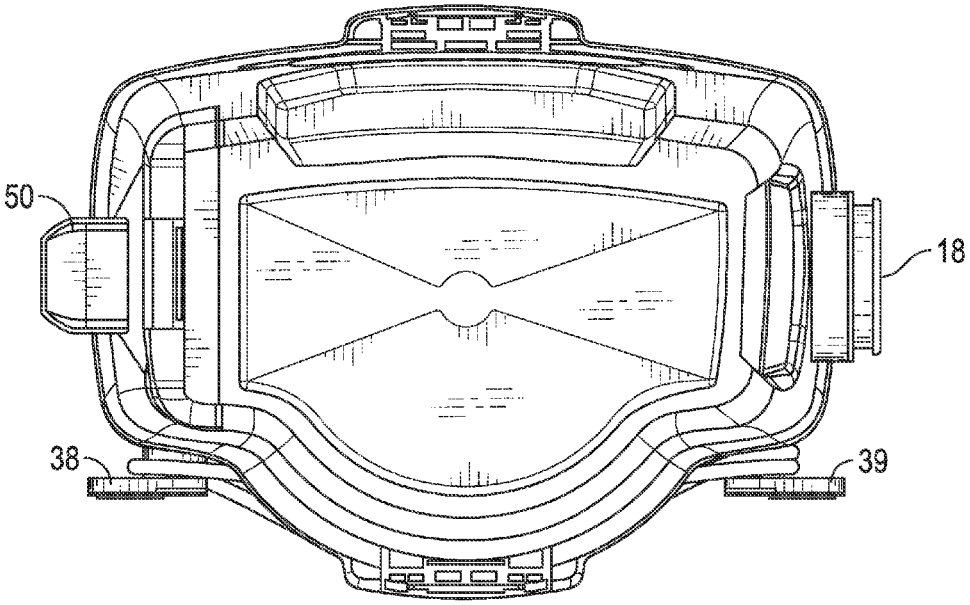
FIG. 4 illustrates a bottom view of the vacuum cleaner assembly of FIG. 1A.

Turning now to the figures, FIG. 1A is an illustration of a front isometric view of a vacuum cleaner assembly in accordance with the present disclosure. FIG. 1B illustrates an alternate front isometric view of the vacuum cleaner assembly of FIG. 1A. FIG. 2 illustrates a front view of the vacuum cleaner assembly of FIG. 1A. FIG. 3 illustrates a top view of the vacuum cleaner assembly of FIG. 1A, with the vacuum hose removed for purpose of clarity. FIG. 4 illustrates a bottom view of the vacuum cleaner assembly of FIG. 3. These figures will be discussed in conjunction with each other.

Figure 5:
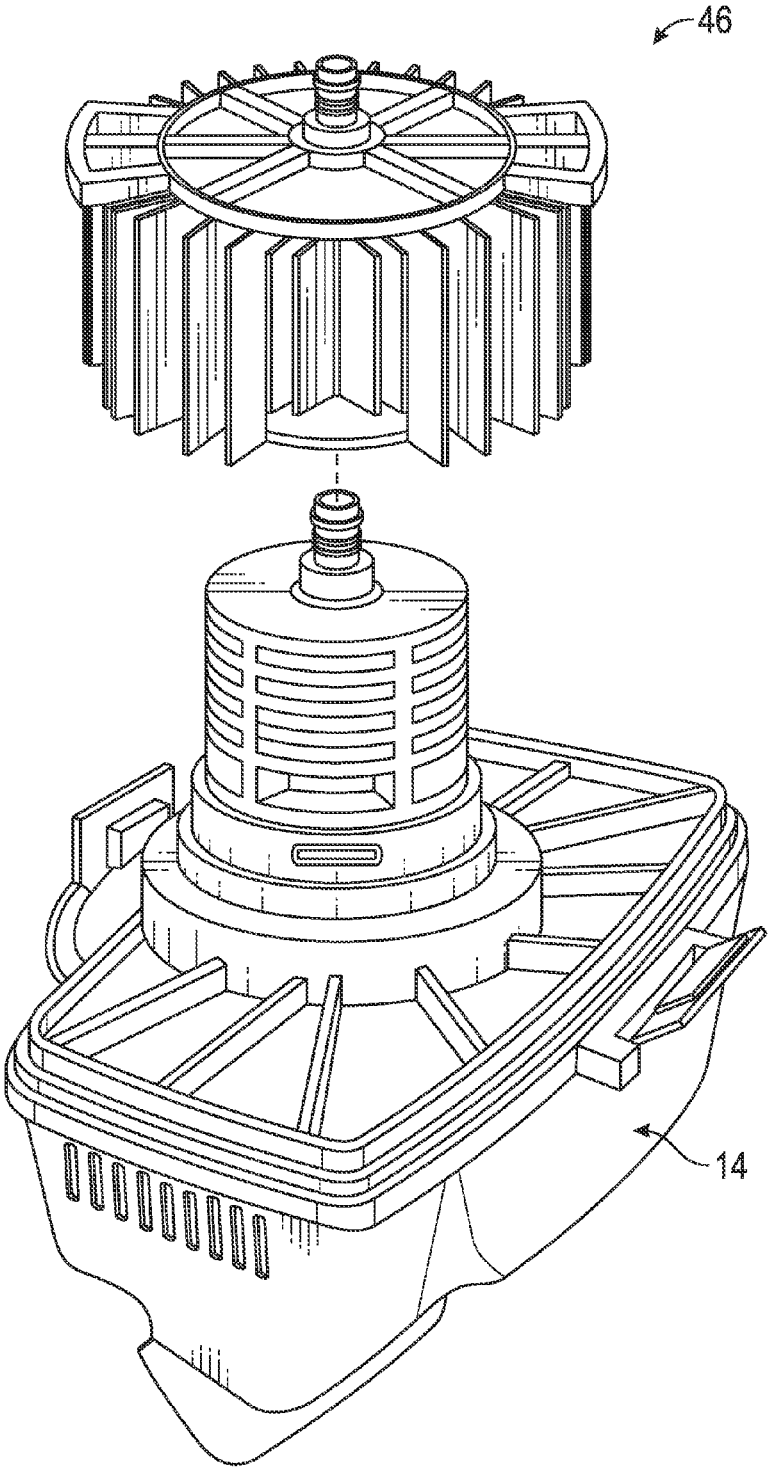
FIG. 5 illustrates an exploded view of the bottom lid of an exemplary vacuum cleaner of the present disclosure.
Figure 6:
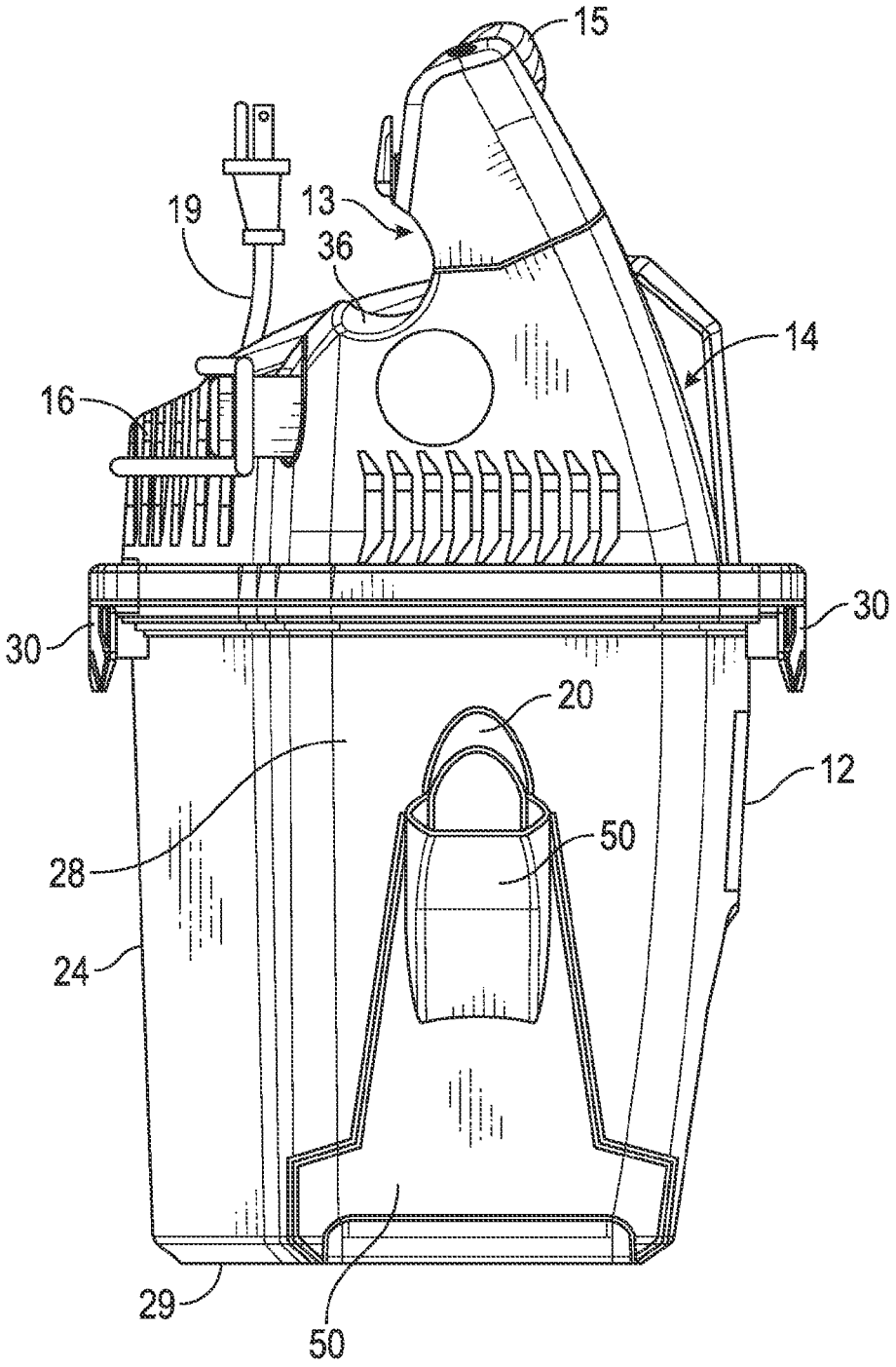
FIG. 6 illustrates a side view of the vacuum cleaner of FIG. 1B, showing the dustpan assembly attached to the drum of the vacuum cleaner.
Figure 7:
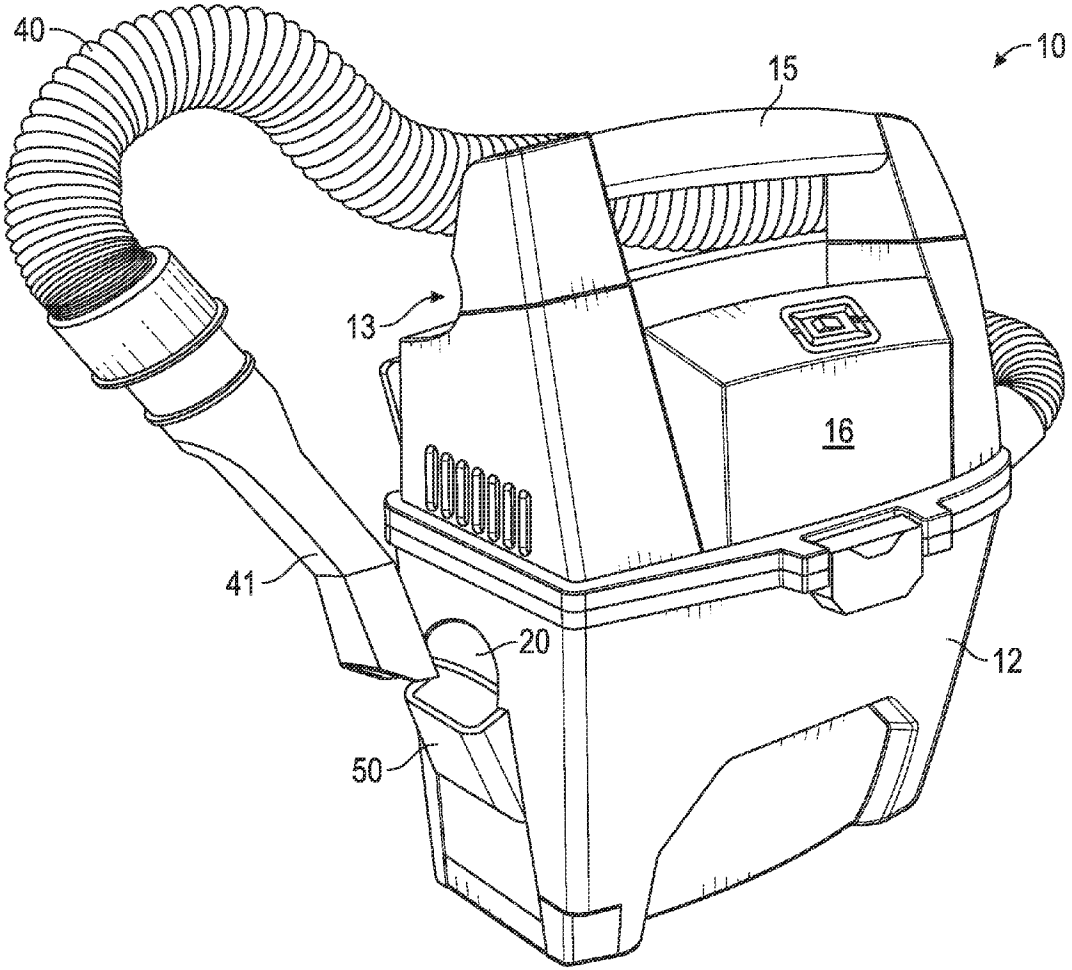
FIG. 7 illustrates an isometric view of a vacuum cleaner of the present disclosure with a dustpan assembly attached to the drum, wherein the nozzle attached to the second end of the vacuum hose is shown out of the nozzle housing opening.
Figure 8:
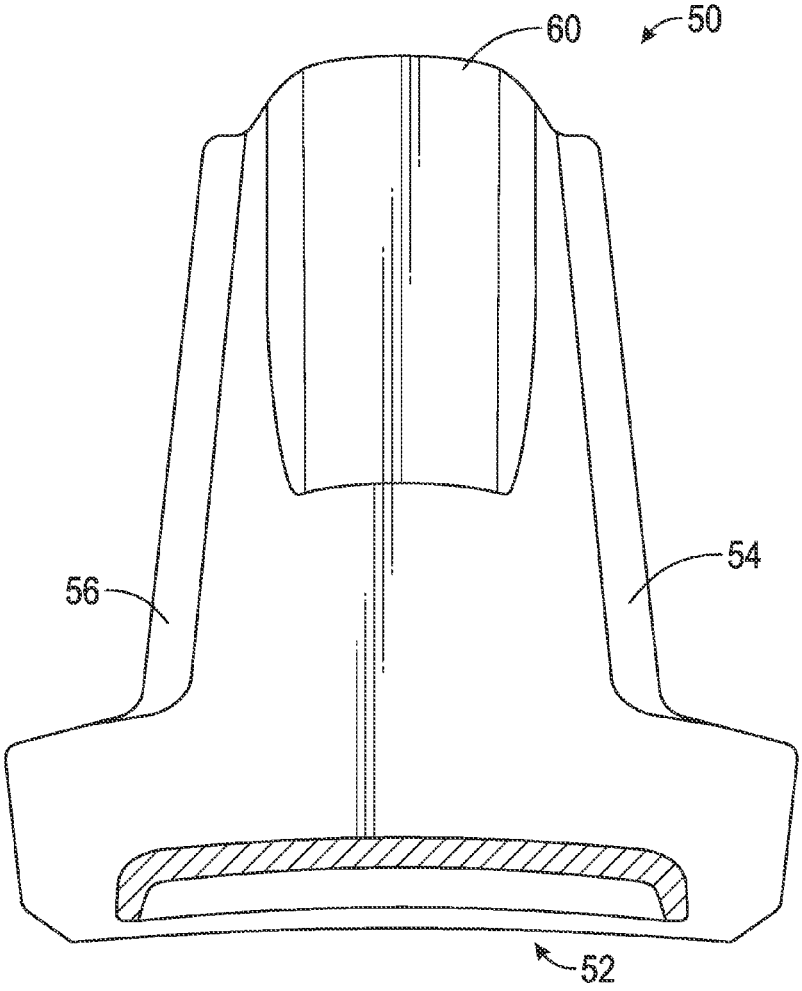
FIG. 8 illustrates a top plan view of a dust pan assembly for a vacuum cleaner of the present disclosure.
Figure 9:
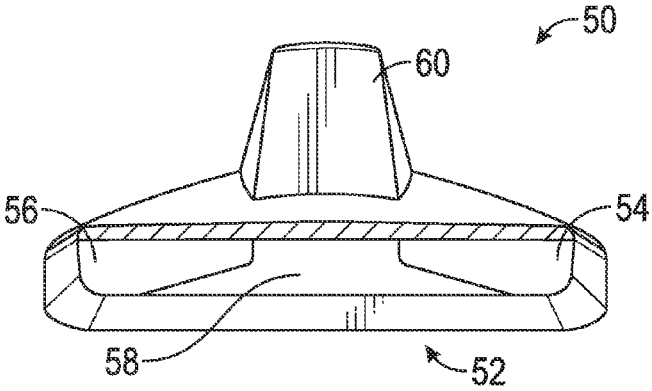
FIG. 9 illustrates a front view of a dust pan assembly for a vacuum cleaner of the present disclosure.
Figure 10:
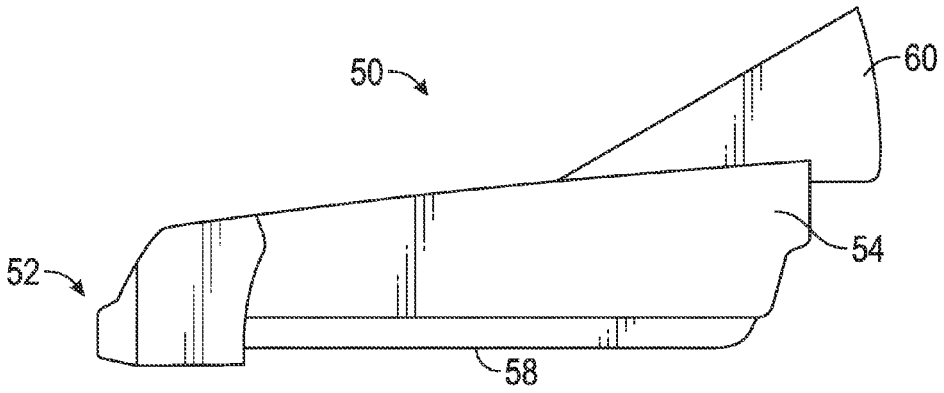
FIG. 10 illustrates a side elevational view of a dust pan assembly of a vacuum cleaner of the present disclosure.
Figure 11:
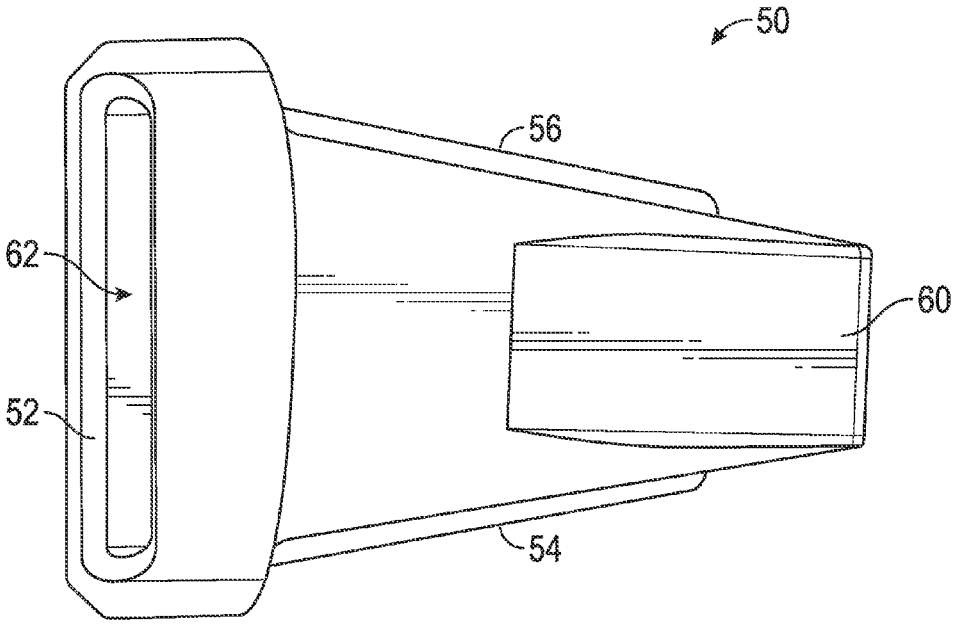
FIG. 11 illustrates a front isometric view of a dust pan assembly of a vacuum cleaner of the present disclosure.
Figure 12:
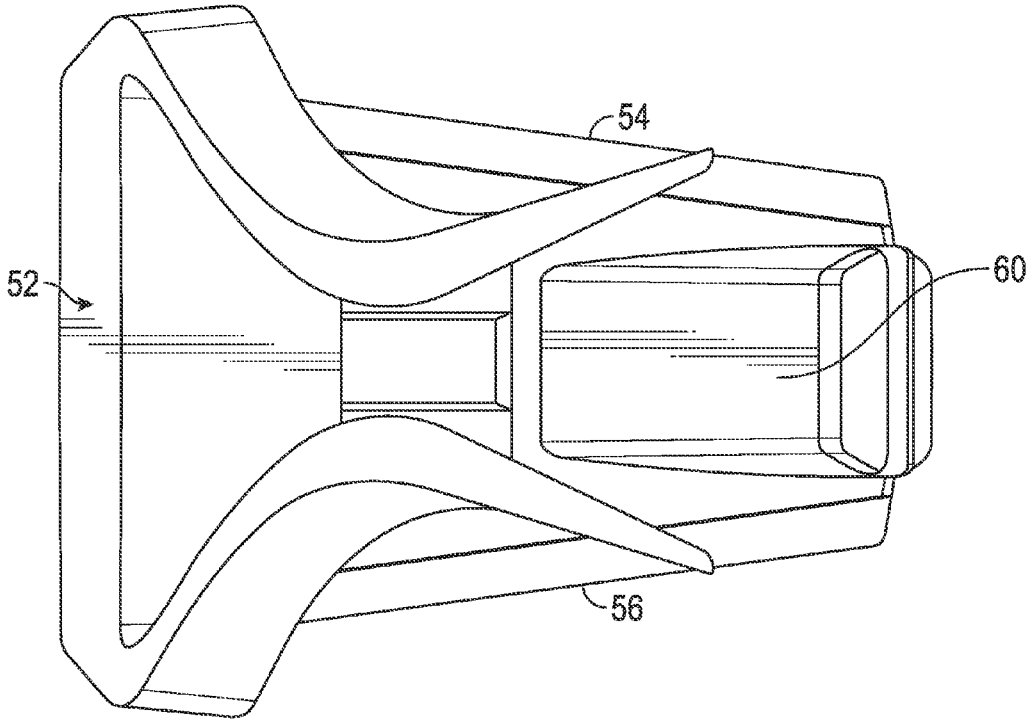
FIG. 12 illustrates a back isometric view of a dust pan assembly of a vacuum cleaner of the present disclosure.
Figure 13:
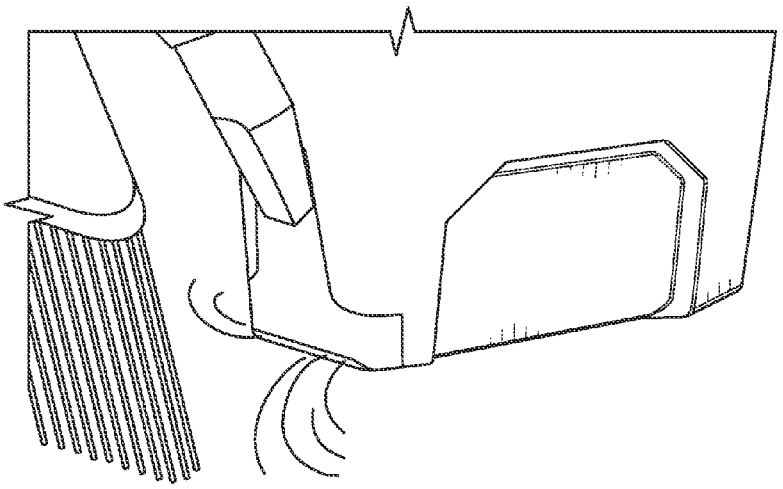
FIG. 13 illustrates the dust pan assembly in use.

As shown generally in FIGS. 1-4, a vacuum cleaner 10 includes a debris collection drum 12, and an upper housing 14 connected to the lower debris collection drum. Preferably, the vacuum cleaner 10 is a wet/dry vacuum cleaner, but this is not necessary in order to utilize the inventions of the present disclosure. The upper housing 14 typically accommodates a motor and impeller assembly (not shown) within the powerhead assembly 16 section of the upper housing 14. The motor and impeller form a suction assembly mechanism that, when operated, creates a suction force that create suction force within the vacuum cleaner 10, the suction force being operable to is collect dirt, debris, and other wet and/or dry waste materials. The suction assembly mechanism (not shown) is in air flow communication with the collection drum 12 through a filter 46 (FIG. 5).

With continued reference to the figures, the upper section of the powerhead assembly 16 section of housing 14 includes a handle 15 for lifting and transporting the vacuum cleaner 10. The handle may be integral with the upper housing, or may extend upwardly from the housing via one or more support arms. Vacuum cleaner 10 can also be moved by rolling it on optionally-included casters (not shown) removably attached to the lower edge(s) of the collection drum 12. One or more accessory storage clips 36 may be located on the upper housing 14, or on the ends of handle 15, as appropriate, so as to allow for the storage of vacuum accessory tools via a pinch-clip type retention mechanism. Handle 15, or the support arms for the handle, may optionally each include a semi-cylindrical channel 13 formed therein, the channels being in alignment with each other, such that a vacuum hose 40 may be retained within the channels by a friction-fit retention when not in use. Further, an on-off power switch 17 is mounted on the upper housing 14 for selectively connecting and disconnecting the motor within the powerhead assembly to a power source. In the embodiment disclosed, electrical power for the motor is provided by a 110-volt source to which the motor unit is connected by an electrical power cord 19. However, it will be understood that power cord 19 is suitable for use with an electrical outlet, an electric motor, an air impeller, various housings, and other associated equipment (all not depicted) that create a low pressure area inside the drum 12 during operation of the vacuum 10. FIG. 3 also shows how electrical power cord 19 can be wrapped around vacuum 10 during transport via cord locks 38, 39 that are pivotally attached to the upper housing 14, and which will be described in more below.

Collection drum 12 is illustrated to be generally rectangular in shape, although this is not a requirement, and collection drum 12 may round, square, ovoid, or any other appropriate shape. As shown, when the drum 12 is generally rectangular, it includes a front face 22, an opposite back face 24, and opposite, generally parallel side walls 26 and 28, as well as a bottom face 29 which is substantially perpendicular to the side walls of the collection drum. The drum 12 further includes a hose inlet 18 (FIGS. 1*a* and 2) sized to receive a vacuum hose 40, and a removable debris pickup port assembly 50, herein alternatively referred to as a removable dust pan assembly. While the dust pan assembly is illustrated to be located within a recess 20 on an exterior wall of the collection drum 12 that is opposite that of the hose inlet 18, this is not necessary. Rather, the dust pan assembly 50 could be located on any wall of the vacuum cleaner drum 12, including on the same wall that the hose inlet 18 is located. This latter instance would be the case if the collection drum 12 were cylindrical and had only one continuous side wall.

The bottom edge of upper housing 14 has a lipped rim 32 which is designed to fit either over the edge of, or alternatively mate with, the upper rim 34 of the collection drum 12 for the vacuum cleaner 10. Around the periphery of the lower region of upper housing 14 are one or more latches 30 which cooperate with catches (not shown) on the exterior of drum 12 in order to hold upper housing 14 on the drum. The combination of the latch 30 and the associated latch catch constitute a drum latching mechanism for detachably securing the upper housing 14 atop the collection drum 12. As can be seen in FIG. 1A, latch member 30 comprises a central "face" element 112, and upper and lower (opposing) elements 114 and 116, respectively. Although central element 112 in the presently disclosed embodiment is substantially planar, it is contemplated that in alternate embodiments central element 112 may have some amount of curvature. A flexible vacuum hose 40 removably connects at a first end 42 to a hose inlet 18 on the collection drum 12. A nozzle 41 (FIG. 1B) is attached at a second, opposite end 44 (FIG. 2) of the hose 40 for collecting debris. As will be discussed in more detail herein, the nozzle 41 is sized so as to be insertable into the dustpan assembly 50 via throat 60 for either storage purposes, or to use the dustpan accessory when the vacuum 10 is in operation. When the vacuum cleaner 10 is in operation, the low pressure created in the drum 12 by the motor assembly within the is power head assembly 16 creates a pressure difference between the interior of the collection drum 12 and the nozzle 41 to cause a suction effect at the nozzle 41. Small debris enters the nozzle 41, travels through the hose 40, and is deposited into the collection drum 12.

Figure 3A:
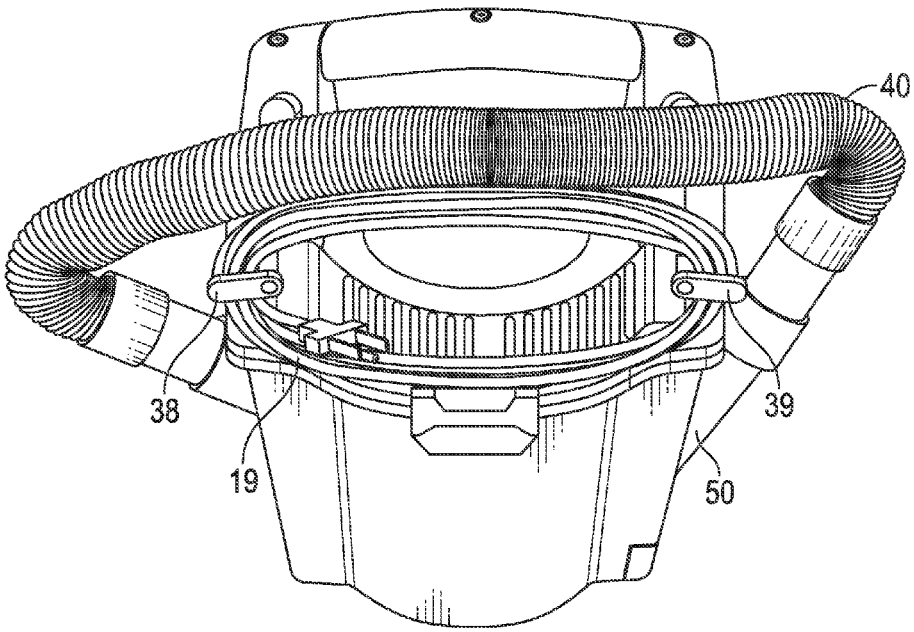
FIG. 3A illustrates an exploded view of an accessory storage clip of FIG. 3.

As stated above, the vacuum cleaner 10 may include two pivotable cord locks 38, 39 to hold power cord 19 in position against the upper housing 14 when not in use. As illustrated in FIG. 3 and FIG. 3A, a power cord can be tightly wrapped around the cord locks 38, 39 as illustrated. In order to provide a quick release of the cord 19 which is wrapped around the cord locks 38, 39, the leg portions of the cord locks can be designed to be pivoted or rotated (e.g., 90 or 180 degrees) to a release position. In the release position, as illustrated in FIG. 3A, the cord 19 which is tightly wrapped around the cord locks 38, 39 can be disengaged from the cord locks without having to manually unwrap each of the windings of the cord 19 from the cord locks 38, 39.

With reference to FIG. 3A, cord locks 38, 39 are pivotally attached to the upper housing 14 by shafts 35, 35', respectively. Each cord lock 38, 39 includes a leg portion 37, 37' which serves as hooks for holding the cord 19 in a horizontal loop position. With continued reference to FIG. 3A, the operation of the cord locks 38, 39 will be described in further detail. The cord locks 38, 39 are shown to be of molded plastic, but they may also equivalently can include a bent wire-form component that can be made from rigid wire, or alternatively, can be molded from metal or other suitable materials. For brevity sake, the operation of only one of the cord locks will be described. In the present description, cord lock 38 will be described in further detail. As described above, the cord lock 38 includes a generally cylindrical shaft region having a first end that is attached to the housing of the vacuum cleaner 10, and a second, opposite end that cooperates with a leg portion extending generally perpendicular to the shaft portion. In the use position, as illustrated in FIGS. 3 and 3A, the cord lock is disposed against the external surface of the upper housing 14 and the is shaft region extends laterally outward. The leg portion is oriented in an opposite direction from the body of the vacuum 10, in order to retain a power cord 19 thereon. The power cord 19 can be wrapped around the shaft portion of cord lock 38 and against the leg portion of the cord lock when the cord lock is in the use position. In order to quickly release the cord from its wrapped position, the cord lock can be pivoted vertically upward or downward to the position as illustrated in FIG. 3A such that the leg portion moved toward the body of vacuum 10 and extends upward or downward from the pivot arm or shaft, and the cord can freely slide rearwardly off of the shaft and the leg portion to allow the power cord 19 to be easily removed. Removal of the power cord can be facilitated by one or both of the cord locks 38, 39 being mounted in the manner described herein. The use of a single pivoting cord lock 38 or 39 would also adequately allow removal of one end of the cord 19 so that the second end can be easily removed by the user.

FIGS. 8-12 illustrate the detachable dust pan assembly 50 in greater detail. The dust pan 50 may comprise a dust and debris holding surface 52 that is partially enclosed on its sides by side walls 54, 56 and fully enclosed at its back side by a back wall 58 (FIGS. 5-9). The top of the dust pan can be partially enclosed by a top section 60 (FIGS. 5, 8, and 9) that is attached to the back wall 58 and attached to the two side walls 54, 56. The dust pan 50 further includes a throat region 60 that is attached to the back wall 58 to facilitate inserting a vacuum tool 41 into the dust pan 50 for storage or to use the dustpan feature of the vacuum 10, or for handling of the dust pan 50 by a vacuum operator when optionally removing or inserting the dustpan 50 into position within a recess 20 adjacent a bottom wall of the collection drum 12, such position being located such that the dustpan is arranged that the lower, dust pan opening 62 is substantially adjacent the bottom surface of the collection drum 12 to allow debris to be manually swept into the dust pan assembly 50.

Other and further embodiments utilizing one or more aspects of the inventions described above can be devised without departing from the spirit of Applicant's invention. For example, a dustpan assembly may be located on a front face of the vacuum cleaner drum, instead of on a side face; or, alternatively, the drum may be cylindrical instead of generally rectangular, and thus the location of the dustpan will be dictated only by the orientation of the vacuum lid and power head assembly. Further, the various methods and embodiments of the methods of use can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A vacuum cleaner comprising:

a lid;

a collection drum having an interior region for collecting solid debris;

a powerhead assembly including a motor assembly attached to the lid, wherein the powerhead is in air flow communication with the collection drum, and wherein the motor assembly draws air from the interior of the collection drum;

a vacuum inlet on a wall of the drum, wherein the inlet directs vacuumed material into the interior region of the collection drum; and a dust pan assembly removably attached to an exterior wall of the collection drum, the dust pan assembly having an open region adjacent a bottom surface of the drum.

2. The vacuum cleaner of claim 1, further comprising a filter cage attached to the lid, such that the filter cage extends downwardly into the collection drum when the lid is attached to the collection drum.

3. The vacuum cleaner of claim 1, wherein the vacuum cleaner is a wet/dry vacuum cleaner.

4. The vacuum cleaner of claim 1, wherein the drum includes at least one partially cylindrical side wall.

5. The vacuum cleaner of claim 1, wherein the vacuum inlet attaches to a hose.

6. The vacuum cleaner of claim 1, wherein the dust pan assembly comprises a front face, two side walls, a bottom face, and a throat opposite the bottom face extending upwardly and sized to receive a vacuum tool at least partially therein.

7. The vacuum cleaner as recited in claim 6, wherein the side walls have a height, and wherein the height is greatest where the side walls attach to the exterior wall of the collection drum, and the height is smallest where the side walls meet the front edge of the debris holding surface.

8. The vacuum cleaner as recited in claim 5, wherein the open region is in fluid communication with the interior of the drum.

9. A vacuum cleaner comprising:

a collection drum having an interior region for collecting solid debris, the drum defined by a bottom surface and at least one upwardly extending sidewall;

a lid secured to a top portion of the drum, the lid including a powerhead assembly, wherein the powerhead is in air flow communication with the collection drum, and wherein the motor assembly draws air from the interior of the collection drum;

a vacuum inlet on the sidewall of the drum, wherein the inlet directs vacuumed material into the interior region of the collection drum; and a dust pan assembly attached to an exterior wall of the collection drum, the dust pan assembly having an opening adjacent the bottom surface of the drum.

10. The vacuum cleaner of claim 9, further comprising a filter cage attached to the lid, such that the filter cage extends downwardly into the collection drum when the lid is attached to the collection drum.

11. The vacuum cleaner of claim 9, wherein the vacuum cleaner is a wet/dry vacuum cleaner.

12. The vacuum cleaner of claim 9, wherein the drum includes at least one partially cylindrical side wall.

13. The vacuum cleaner of claim 9, wherein the vacuum inlet attaches to a hose.

14. The vacuum cleaner of claim 9, wherein the dust pan assembly comprises a front face, two side walls, a bottom face, and a throat opposite the bottom face extending upwardly and sized to receive a vacuum tool at least partially therein.

15. The vacuum cleaner as recited in claim 14, wherein the side walls have a height, and wherein the height is greatest where the side walls attach to the exterior wall of the collection drum, and the height is smallest where the side walls meet the front edge of the debris holding surface.

16. The vacuum cleaner as recited in claim 13, wherein the opening of the dust pan assembly is in fluid communication with the interior of the drum.

17. A vacuum cleaner comprising:

a collection drum having an interior region for collecting solid debris, the drum defined by a bottom surface and at least one upwardly extending sidewall;

a vacuum inlet on the sidewall of the drum, wherein the inlet directs vacuumed material into the interior region of the collection drum;

a hose attached to the vacuum inlet;

a tool attached to the hose;

a lid secured to a top portion of the drum, the lid including a powerhead assembly, wherein the powerhead is in air flow communication with the collection drum, and wherein the motor assembly draws air from the interior of the collection drum, thereby creating a vacuum within the drum and drawing air and debris through the hose and tool; and a dust pan assembly attached to an exterior wall of the collection drum, the dust pan assembly having an opening adjacent the bottom surface of the drum and a throat for receiving the tool.

18. The vacuum cleaner of claim 17, further comprising a filter cage attached to the lid, such that the filter cage extends downwardly into the collection drum when the lid is attached to the collection drum.

19. The vacuum cleaner of claim 17, wherein the vacuum cleaner is a wet/dry vacuum cleaner.

20. The vacuum cleaner as recited in claim 17, wherein the opening of the dustpan assembly is in fluid communication with the tool, the hose, and the interior of the drum.

* * * * *